US007661384B2

(12) United States Patent
Mataya

(10) Patent No.: US 7,661,384 B2
(45) Date of Patent: Feb. 16, 2010

(54) CLOSURE CAP FOR A CONTAINER HAVING TIME-DATE INDICATORS

(76) Inventor: Marc J Mataya, 4935 Prentice Pl., Charlotte, NC (US) 28210

( * ) Notice: Subject to any disclaimer, the term of this patent is extended or adjusted under 35 U.S.C. 154(b) by 1138 days.

(21) Appl. No.: 11/043,338

(22) Filed: Jan. 26, 2005

(65) Prior Publication Data

US 2006/0180566 A1 Aug. 17, 2006

(51) Int. Cl.
*G09F 9/00* (2006.01)

(52) U.S. Cl. ..... 116/311; 116/307; 116/308; 116/309; 40/311; 206/534; 215/230

(58) Field of Classification Search ..... 116/306–309, 116/311, 312, 315–317, 319, 320, 298–300, 116/305, 318, 337, DIG. 37; 40/310, 311, 40/107, 111, 113–115, 503, 506; 206/534, 206/459.1, 459.5; 215/206, 228, 230, 365; D9/435, 436

See application file for complete search history.

(56) References Cited

U.S. PATENT DOCUMENTS 429,949 A * 6/1890 Palmersten ..... 40/115
1,711,711 A * 5/1929 Woolley ..... 116/318
1,755,696 A * 4/1930 Kluge et al. ..... 40/115
2,450,949 A 10/1948 Gattuccio et al.
3,215,344 A * 11/1965 Joffe ..... 235/78 RC
3,828,519 A * 8/1974 Levey ..... 53/420
3,830,394 A * 8/1974 Lestaevel ..... 215/206
4,053,077 A 10/1977 DeFelice
4,345,541 A 8/1982 Villa-Real
4,365,722 A 12/1982 Kramer
4,482,068 A 11/1984 Agbay et al.
4,705,182 A 11/1987 Newel-Lewis
4,756,423 A 7/1988 Holtsch
5,277,325 A 1/1994 Yan
5,433,324 A 7/1995 Leonard
5,577,335 A * 11/1996 Tucker ..... 40/311
5,638,970 A * 6/1997 Garby et al. ..... 215/219
5,732,836 A * 3/1998 Barker et al. ..... 215/230
5,778,818 A 7/1998 Marshall
5,779,651 A 7/1998 Buschmann et al.
6,032,609 A 3/2000 Luoma
6,068,149 A 5/2000 Telega
6,084,504 A 7/2000 Rosche et al.
6,089,835 A 7/2000 Suzuura et al.
6,138,866 A 10/2000 Lambelet, Jr. et al.
6,152,067 A 11/2000 Mathison
6,302,295 B1 10/2001 Weisman
6,439,409 B1 8/2002 Dressel et al.
6,545,592 B2 4/2003 Weiner
6,604,650 B2 8/2003 Sagar
6,612,461 B2 9/2003 Layer et al.

(Continued)

*Primary Examiner*—Amy Cohen Johnson
(74) *Attorney, Agent, or Firm*—Ralph H. Dougherty

(57) ABSTRACT

A closure cap for a product container such as a prescription medicine vial, that has a number time and date dials for reminding a user when to take the next dose. The cap's time and date dials are rotatable together or individually with the use of uniquely shaped turning tabs. The dials allow for a user to set the reminder to indicate any hour of the day, any day of the week, and any date of the month. The cap may also have a next and last dose setting. The cap may also have a locking mechanism to prevent inadvertent changes to the set time.

21 Claims, 4 Drawing Sheets

U.S. PATENT DOCUMENTS 6,652,047 B1 11/2003 Maguire, Jr.
6,667,936 B1 12/2003 Ditzig
D490,707 S 6/2004 Mataya
6,805,072 B1 10/2004 DeSano
7,147,127 B2 * 12/2006 Lepke et al. ..... 221/4
2003/0136753 A1 7/2003 Biesecker et al.

* cited by examiner

CLOSURE CAP FOR A CONTAINER HAVING TIME-DATE INDICATORS

FIELD OF THE INVENTION

The present invention relates to product containers and more particularly to the closure caps for prescription vials having time-date indicators.

BACKGROUND OF THE INVENTION

Prescription drugs are a constant growing component to our health care system. Almost half of all Americans take at least one prescription drug. Almost half of all Americans over the age of 65 take three or more prescription drugs. Typically, the effectiveness of the drug or drugs are dependent on the user following the instructions of the prescribing physician, i.e. taking the right amount of the drug at the right time, which is referred to as compliance. However, users frequently forget when to take their next dosage or whether they have taken their last dosage or not, which leads to them either skipping a dosage or repeating a dosage.

Devices to help remind or keep track of a user's drug intake are known. Integrating these devices into the closure caps of the medicine containers that hold the drugs is also known. The integration of the device into the closure cap is advantageous because it prevents the reminder device from being separated from the drugs.

Known integrated devices typically have a limited time duration that they can effectively track or indicate. Specifically, many known devices can only indicate the number of hours or the next day for the next dosage. However, displaying limited time information is problematic when the dosage duration is greater than a day or a week.

Another problem with some known integrated devices is the difficulty users may have in reading and understanding the indicia. The size of the text or reading the text though a small viewing cut-out may make reading the text difficult. Also the layout of the indicia may be confusing making it difficult to understand.

An additional drawback with some of the known integrated devices is the possibility of inadvertently changing the reminder device when the user is trying to remove the closure cap to access the drugs. This is especially likely when the same kind of rotational movement is necessary to either set the reminder device or remove the closure cap from the container.

Cost is another drawback with some of the known integrated devices. Pharmacists are not allowed to reuse medicine containers such as vials or the closure caps for the vials. The caps, even with an integrated time reminder device, are disposed of once the drugs in the vial are used up. Because the caps are a disposable item, the users and drug companies are sensitive to cost associated with them.

In light of the foregoing, it is desirable to provide an inexpensive integrated and disposable time reminder closure cap for a medicine vial that is easy to read and use. It would be advantageous for the time-reminder cap to work with prescriptions having a variety of dosage durations, including durations greater than a day. Furthermore, it would be advantageous if the closure cap had protection against inadvertent changes to the time-date indicators.

BRIEF SUMMARY OF THE INVENTION

The present invention addresses the above needs and achieves other advantages by providing a closure cap for a prescription medicine vial that has a number of time and date dials for reminding a user when to take the next dose or when they had taken their last dose. The cap's time and date dials are rotatable together or individually with the use of ergonomically and uniquely shaped turning tabs. The dials allow for a user to set the reminder to indicate any hour of the day, any day of the week, and/or any date of the month. Also, the cap may have a lock position to prevent inadvertent changes to the set time.

In one embodiment, the cap has a top, a base, and a plurality of dials listing time-date indicia. The dials are rotatable about a support post on the base. The dials may be configured to rotate in one or more directions.

Each dial includes a turning tab that is uniquely shaped to assist a user to activate one or more of the dials. For example and as illustrated, the closure cap may have three dials. The turning tab on the top dial is configured to extend up and away from the middle dial. The turning tab on the bottom dial is configured to extend down and away from the middle dial. The turning tab on the middle dial is configured to extend away from the support post and beyond the turning tabs of the top and bottom dials.

The base may further have a seal and plurality of lugs. The lugs are for engaging a medicine vial or bottle. The seal closes off the drugs in the vial from the cap and facilitates the engagement of standard child-resistant vials.

In another embodiment, the invention provides a time-reminder cap for a prescription medicine bottle or vial. The cap has a top, base, and at least one dial listing time-date indicia. The top has a protruding stalk and the base has a support post. The support post is configured to receive and hold the protruding stalk, thereby connecting the top and base together. The dial or dials are not rotatable around the support post when the top is in a first position and is rotatable when the top is in a second position.

The top may also have a third position. In the third position, the top is rotatable about the support post. Furthermore, a "NEXT DOSE" or "LAST TAKEN" marking may be selected with the rotating of the top.

The present invention has several advantages. The multiple time-date dials allow the user to track a wider range of time durations than the typical known time-reminder devices associated with prescription bottles. Also, the unique turning-tabs allow the user to rotate one or more dials with a less likely chance of rotating the wrong dials. The ability to lock the dials in place prevents inadvertent changes to the time-date setting when the cap is being removed or put on the vial. The cap can be configured to engage a variety of types of vials including child-resistant vials.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 1:
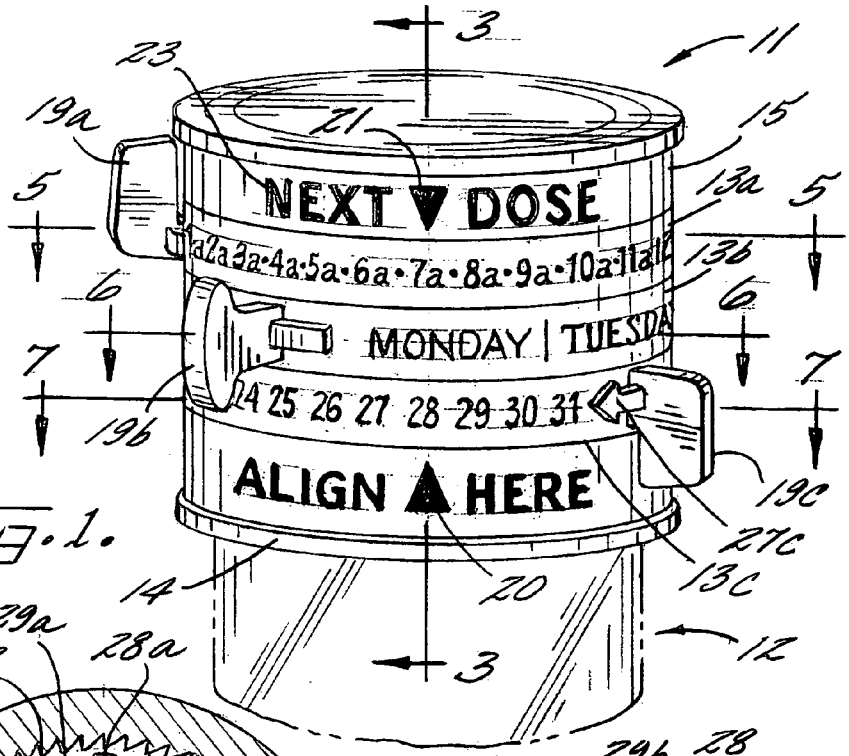
FIG. 1 is a perspective view of one embodiment of the closure cap of the present invention, where the top is set to display a "NEXT DOSE" setting.
Figure 5:
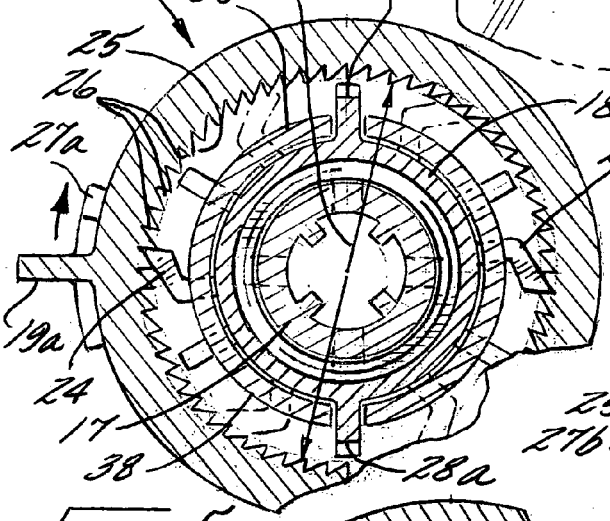
Figure 6:
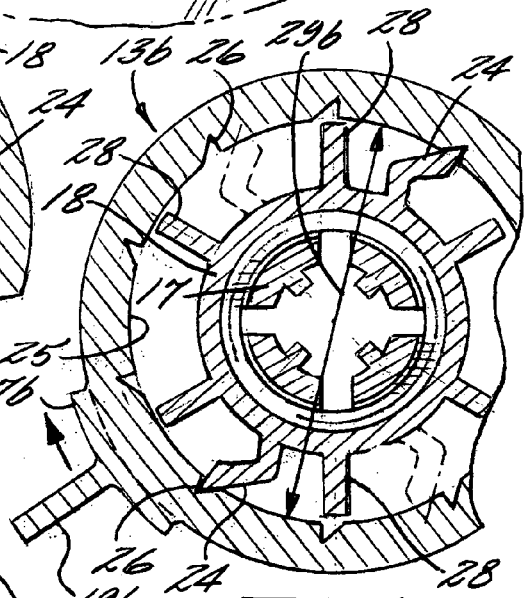
Figure 7:
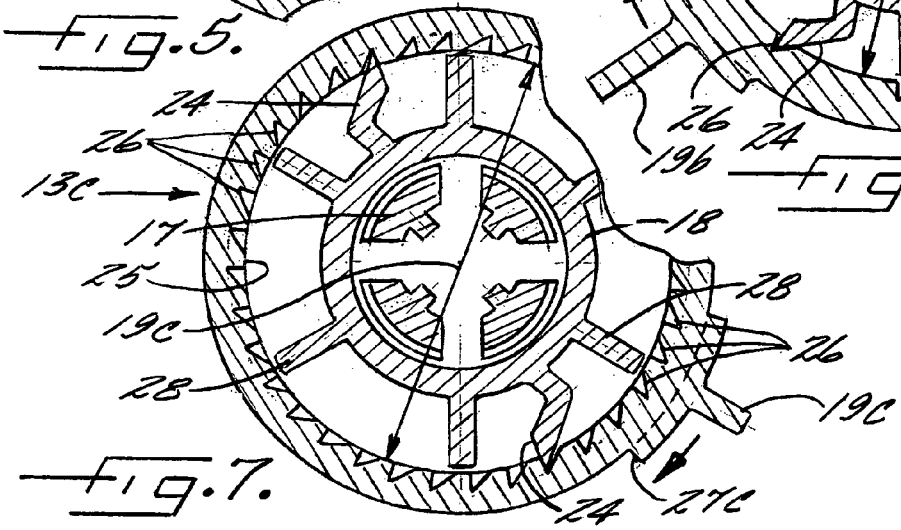
Figure 3:
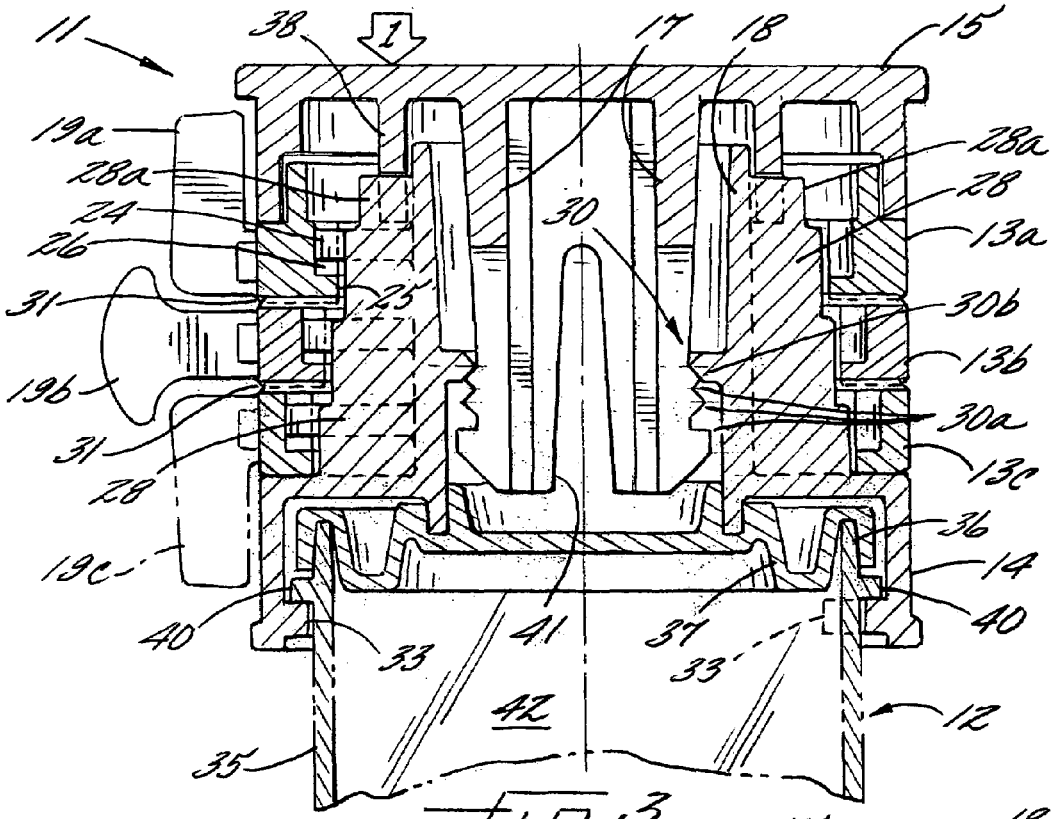
FIG. 3 is a cross-sectional view of the closure cap taken along the 3-3 line of FIG. 1, wherein the top is in a first position where the dials can not rotate.
Figure 4A:
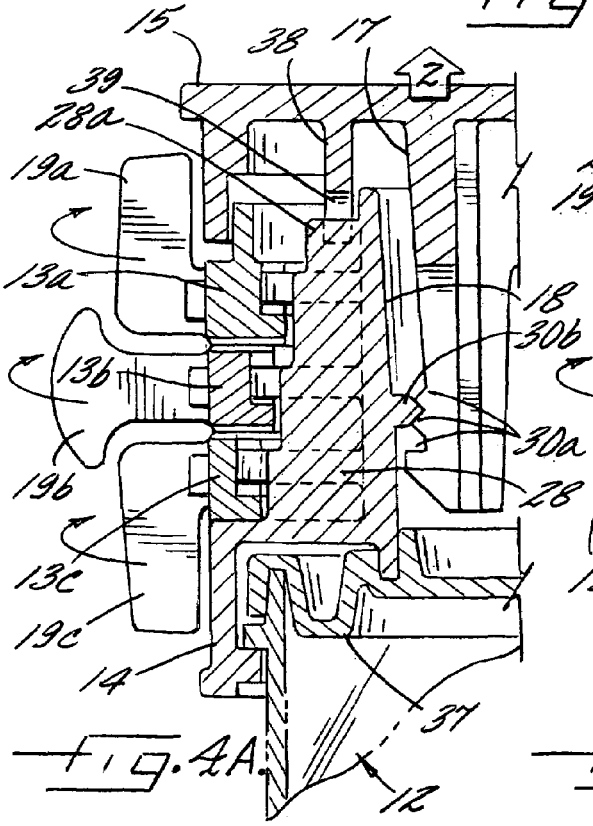
Figure 4B:
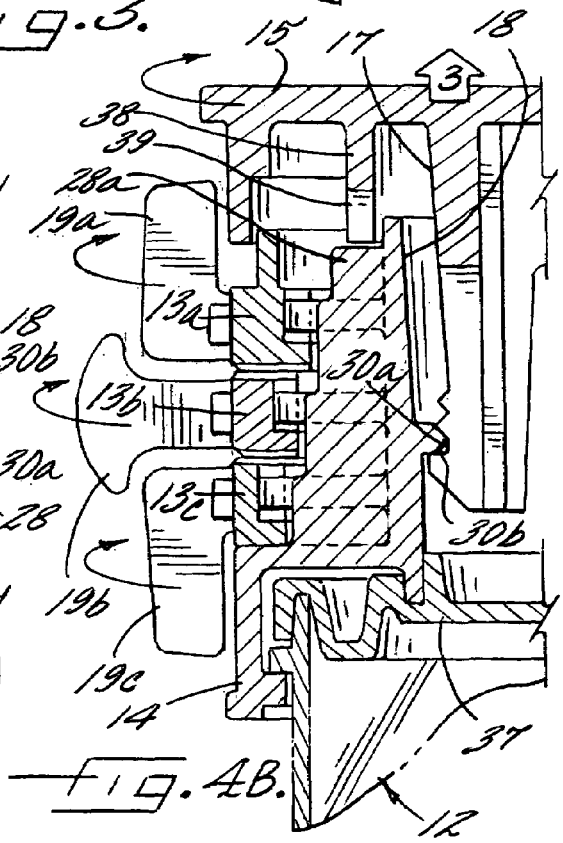
Figure 8:
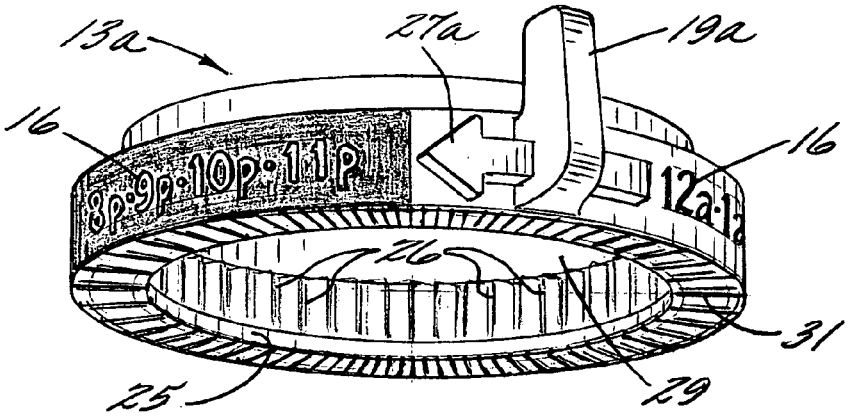
Figure 9:
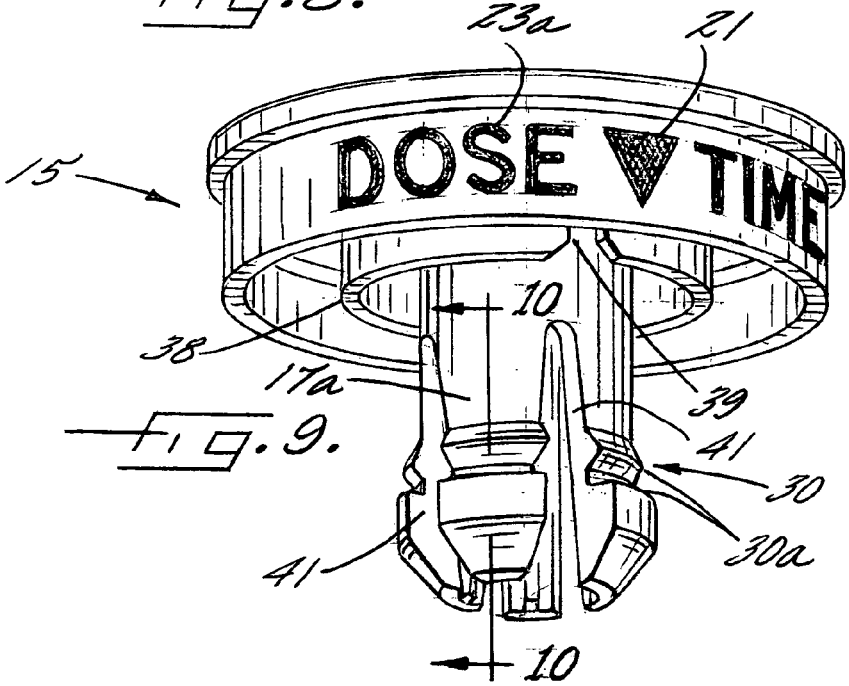
Figures 10A, 10B:
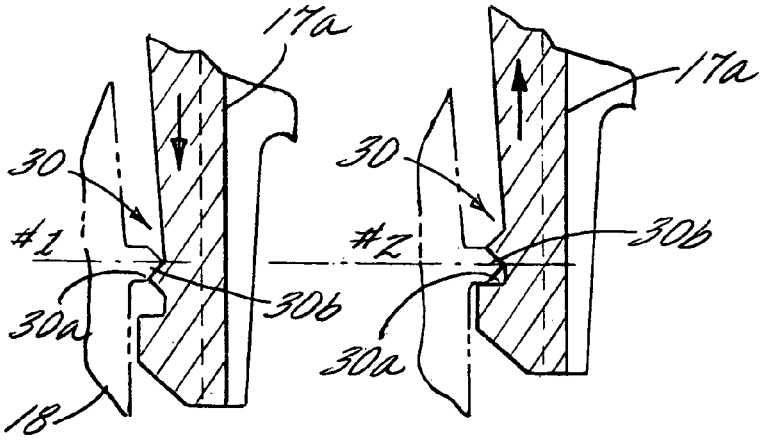

FIG. 4*a* is a partial of the cross-sectional view of FIG. 3, wherein the top is in a second position where the dials can rotate;

FIG. 4*b* is a partial of the cross-sectional view of FIG. 3, wherein the top is a third position where the top can rotate as well as the dials;

FIG. 5 is a cross-sectional view of the closure cap taken along the 5-5 line of FIG. 1;

FIG. 6 is a cross-sectional view of the closure cap taken along the 6-6 line of FIG. 1;

FIG. 7 is a cross-sectional view of the closure cap taken along the 7-7 line of FIG. 1;

FIG. 8 is one embodiment of a time-date dial displaying the hours of the day wherein the ante meridiem and post meridiem hours have contrasting backgrounds;

FIG. 9 is another embodiment of the top of the present invention for a closure cap that does not have third position where the top is rotatable and the top has only one setting, i.e. "DOSE TIME";

FIG. 10*a* is a partial cross-sectional view of the closure cap taken along the 10-10 line of FIG. 9, wherein the top is in a first position where the dials can not rotate; and FIG. 10*b* is a partial cross-sectional view of the closure cap taken along the 10-10 line of FIG. 9, wherein the top is in a second position where the dials can rotate.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather these embodiments are provided so that this disclosure will satisfy applicable legal requirements. Like numbers refer to like elements throughout.

In general, as shown in the figures, the present invention includes a closure cap 11 for a medicine vial 12, the cap 11 having a number of time-date dials 13 for reminding the user to take the next dose of medicine. The cap 11 includes a base 14, top 15, and a number of dials 13 listing time-date indicia 16.

Figure 2:
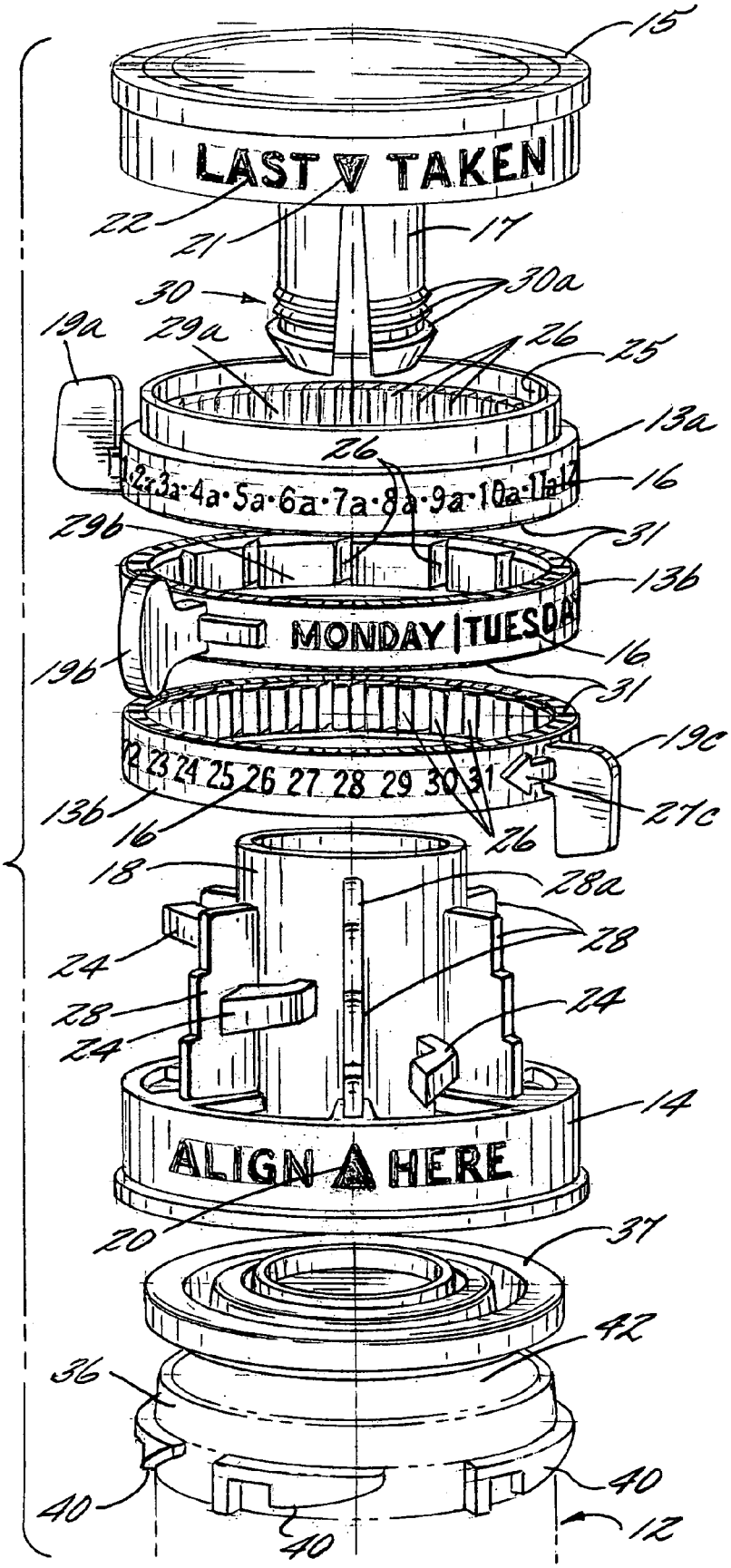
FIG. 2 is an exploded view of the closure cap of FIG. 1, where the top has been rotated 180° so as to display a "LAST TAKEN" setting.

According to the illustrated embodiment, the number of dials 13 is three. The top 15 has a protruding stalk 17. The base 14 has a generally cylindrical support post 18 that is configured to receive and hold the protruding stalk 17. One preferred way of engaging the stalk 17 with the support post 18 is by inserting the stalk 17 into the center of the support post 18. Splits 41 formed in the stalk 17 make the stalk 17 compressible, as shown in FIGS. 2 and 9, facilitating the insertion. The stalk 17 is held in place by ridges 30 formed on the stalk 17 and one ridge 30*b* on the inside of the support post 18.

The dials 13 are rotatable around the support post 18. As shown in FIGS. 1-4, each dial 13 has a uniquely shaped turning tab 19 to assist the user in rotating one or more of the dials 13. More specifically, the turning tab 19*a* on the top dial 13*a* is configured to extend up and away from the middle dial 13*b*. The turning tab 19*c* on the bottom dial 13*c* is configured to extend down and way from the middle dial 13*b*. The turning tab 19*b* on the middle dial 13*b* is configured to extend away from the support post 18 and beyond the turning tabs 19*a* and 19*c* of the top and bottom dials 13*a* and 13*c*.

As shown in FIGS. 1 and 2, the top dial 13*a* displays the twenty-four hours of a day. The middle dial 13*b* displays every day of the week. The bottom dial 13*c* displays the thirty-one possible dates of any given month. Any possible hour, day, and date combination may be set by rotating the dials 13 so that the right indicia 16 aligns between a bottom selector arrow 20 printed on the base 14 and a top selector arrow 21 printed on the top 15. FIG. 8 illustrates an alternative embodiment of the top dial 13*a* where the ante meridiem and post meridiem hours have contrasting backgrounds Also, in some embodiments, the top 15 may provide additional indicia settings. For example and as shown in FIGS. 1 and 2, the top 15 may have a "LAST TAKEN" 22 and "NEXT DOSE" 23 indicia setting to clarify whether the indicia 16 is indicating when the last dose was taken or whether when the next dose is due. Alternatively, as shown in FIG. 9, the top 15 may have only one indicia setting 23*a*, such as "DOSE TIME". Another example, not shown, of a top 15 indicia setting is "LAST APPLIED."

It should be understood that the illustrated embodiments are only a few of the possible embodiments for this invention. One skilled in the art would appreciate the various combinations of dials 13 that this invention may employ, including increasing or decreasing the number of dials 13, changing the type or format of indicia 16 on a particular dial or dials 13, or changing the order of the dials 13. For example, the hour indicia could be replaced with a year indicia. Furthermore, the manner in which the indicia 13 are marked or printed on the dials 13 may vary, including the use of stickers or decals and/or physically or chemically altering one or more of the surfaces of the dials 13 to form the indicia 16.

The dials 13 may be rotatable in only one direction. For example, as generally shown in FIG. 2, the support post 18 may have a series of indexing-limbs 24. More specifically and referring to FIGS. 5-7, for each dial 13 there is a pair of indexing-limbs 24 on the support post 18 that are positioned to engage a dial 13. Each dial 13 has an inner surface 25 comprising of indexed indentations 26. Each indentation 26 has an angled side and an opposite side that is perpendicular with the dial 13. The indexing-limbs 24 engage the indexed indentations 26 allowing for the rotation of the dial 13 in only one direction. This single direction indexing encourages the dials 13 to click and snap into place while being turned or rotated.

When an indexing-limb 24 passes over an opposite side over an indentation 26, the dial 13 will snap to the center of the next indentation 26. This motion can be used to control and assist the rotating and setting of the dial 13. For example and as illustrated, the bottom dial 13*c* displays the numbers one through thirty-one to indicate possible dates of a given month. Each number is generally centered about an indexed indentation 26 on the inner surface 25 of the bottom dial 13*c*. Also, the turning tab 19*c* and a directional arrow 27*c* on the bottom dial 13*c* are centered on an indexed indentation 26 giving the bottom dial 13*c* a total of thirty-two index indentations 26. As the bottom dial 13*c* rotates, it will click and snap between the number markings, making it easier for the user to align the proper date on the dial 13*c* with the top and bottom selector arrows 21 and 20.

Alternatively, in some embodiments, not shown, the dials 13 may be rotatable in both directions, i.e. clockwise and counter-clockwise. For example, each indexed indentations 26 may have two angled sides and not an opposite side that is perpendicular with the dial 13. The two angled sides of each indentation 26 allow the indexed limbs 24 to pass over either side of an indexed indentation 26, and thus rotate the dial 13 in either direction. Also, the number of indexing clicks may be adjusted and varied to better align the surface indicia 16.

In another aspect of the invention, as shown in FIGS. 3-7, the support post 18 has a series of planar supports 28. The planar supports 28 extend horizontally from the support post 18 to the dials 13 and extend vertically along the length of the support post 18. The planar supports 28 provide rigidity to the dials 13 and prevent the dials 13 from becoming out-of-round.

In the illustrated embodiments, best shown in FIGS. 3 and 4, the dials 13 have different inner diameters 29 according to the placement of each dial 13 on the support post 18. More specifically, the inner diameter 29 for each dial 13 increases from the top dial 13*a* down to the bottom dial 13*c* so that the top dial 13*a* has the smallest inner diameter 29*a* and the bottom dial 13*c* has the largest inner diameter 29*c*. Accordingly, the sizes of the indexing-limbs 24 vary to match the inner diameter 29 of the dial 13 that each limb 24 engages. Also, the planar supports 28 have a step-like profile, best shown in FIG. 2, to match the diameters 29 of the dials 13, as shown in figures.

The varying diameters and sizes of the dials 13 and indexing limbs 24 facilitated the assembly of the cap 11, by preventing damage to the indexing limbs 24 when the dials 13 were placed around the support post 18.

Yet in another aspect of the invention, the top 15 may have more than one position. For example, the top 15 may have a lock position and an unlock position. In the lock position, as shown in FIG. 3 and indicated by the number one enclosed in the downward facing arrow, the dials 13 can not rotate. In the unlock position, as shown in FIG. 4*a* and indicated by the number two enclosed in the upward facing arrow, the dials 13 can rotate.

Selecting between the lock and unlock position, may be accomplished by moving the top 15 up and down relative to the base 14 between stop positions. The stop positions are formed by ridges 30*a* in the protruding stalk 17 and one ridge 30*b* in the support post 18. The ridges 30*a* on the stalk 17 are configured to engage the ridge 30*a* on the inside of the support post 18 whenever the ridges 30 pass one another. When the top 15 is pushed all the way down into the lock position, i.e. the first stop position, the dials 13 are compressed by the base 14, the top 15, and each other. While compressed, the dials 13 are inhibited from rotating by the forces exerted by the adjacent dials 13, base 14, or top 15. Serrations or offsetting bumps 31, best shown in FIG. 2, may be added to the adjacent surfaces of the dials 13, in order to increase the friction between the dials 13 to help prevent their movement when in the lock position. When the top 15 is pulled or put into the unlock position, i.e. the second stop position, the top 15 and base 14 are no longer compressing the dials 13 and the dials 13 are rotatable individually or together.

In some embodiments, the top 15 has a third stop position, as shown in FIG. 4*b* and indicated by the number three enclosed in the upward facing arrow. In this position, the top 15 may rotate about the support post 18, which is desirable when the top 15 contains printed indicia as well. For example and as described above, the top 15 may have a "LAST TAKEN" 22 and a "NEXT DOSE" 23 indicia setting, or alternatively a "LAST APPLIED" and a "NEXT APPLICATION" indicia setting. The top 15 has an underside with a general circular ridge 38 extending downward and around the protruding stalk 17, best seen on FIG. 9. The circular ridge 38 contains a number of notches 39. When the top 15 is in either the lock or unlock positions these notches 39 engage one or more extensions 28*a* of some or all of the planar supports 28 preventing the top 15 from rotating. As shown in FIGS. 3 and 4, when the top 15 is pulled up to the third stop position above the second stop position, the notches 39 are above and clear of the planar support extensions 28*a* allowing for the top 15 to rotate. In order to accommodate a third position, the protruding stalk 17 may be extended to add an additional ridge 30*a* on the stalk 17 and allow for the additional vertical movement for the circular ridge 38 to clear the planar support extensions 28*a*. FIG. 9-10 illustrate a top 15 configured not to have the third position, i.e. the stalk 17*a* has only two ridges 30*a*.

As illustrated, the closure cap 11 may be used with an existing or new medicine bottle or vial 12. The medicine vial 12 includes a tubular side wall 35 defining an interior space 42 for storage. The side wall 35 has an upper edge area 36 for circumscribing an opening of the vial 12 and receiving the closure cap 11. The base 14 may have a plurality of lugs 33 along an inner face for engaging the upper edge area 36, as shown in FIGS. 3 and 4. The base may also include a seal 37 for separating the contents inside the vial 12 from the closure cap 11 and assisting in the engaging and disengaging of the lugs 33 to the upper edge area 36. For example, the seal 37 may be a soft and flexible plastic diaphragm above the lugs 33.

One skilled in the art would appreciate the fact that the lugs 33 and the seal 37 may be configured to engage the upper edge area 36 of a variety of known types of containers and vials 12, including child-resistant and non-child-resistant bottles or vials 12. The standard child-resistant vial 12 requires the user to "push-n-turn" the cap 11 in order to engage or disengage the cap 11 with the vial 12. In particular, the seal 37 flexes allowing the lugs 33 to clear any child-resistant notches 40, as shown in FIG. 2, in the upper edge area 36 when the user pushes down on the cap 11, then the user may turn the cap 11 so as to align the lugs 33 to the opening between the child-resistant notches 40 and lift up and remove the cap 11 from the vial 12.

Although the closure cap 11 is illustrated and described for use with a medicine container or vial 12, this invention is not limited to such use. Specifically, the closure cap 11 may be used with a variety of product containers. Preferably, the closure cap 11 works with a container storing product that is time sensitive to either its application or consumption. For example, the closure cap 11 may work with a fertilizer container to help remind the user when to apply the next treatment of fertilizer. Other examples include, but are not limited to, containers storing baby formula, agricultural products, pool and spa chemicals or pesticides.

The present invention has several advantages. The multiple time-date dials 13 allow the user to track a wider range of time durations than the typical known time-reminder devices associated with prescription bottles or vials 12. Also, the unique turning-tabs 19 allow the user to rotate one or more dials 13 with a less likely chance of rotating the wrong dials 13. The indexed indentations 26 on the dials 13 and the indexing limbs 24 facilitate the setting of the dials 13 by controlling the direction of rotation and creating a snapping movement between indicia markings 16 on the dials 13. The ability to lock the dials 13 in place prevents inadvertent changes to the time-date setting when the cap 11 is being removed or put on the vial 12. The cap 11 can be configured to engage a variety of types of vials 12, including child-resistant ones.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A closure cap for a medicine bottle or vial that has multiple rotating time and date dials for reminding a user when to take a dose, said cap comprising: a base including a support post; a top configured to engage the support post; a plurality of dials listing time-date indicia wherein the dials are rotatable around the support post, said plurality of dials include a turning tab on each dial wherein the turning tabs are configured in a manner to have a unique shape to assist a user to activate one or more dials; and indicator means on said cap for designating a specific date and time; said can having integral means for connecting said can to said bottle or vial wherein said plurality of dials comprises a top dial, middle dial and bottom dial and the turning tab of the top dial is configured to extend up and away from the middle dial, the turning tab of the bottom dial is configured to extend down and away from the middle dial, and the turning tab of the middle dial is configured to extend away from the support post and beyond the turning tabs of the top and bottom dials.

2. The cap of claim 1, further comprising means for rotating said dials only in one direction.

3. The cap of claim 1, wherein the base further comprises a plurality of lugs for engaging the medicine bottle or vial.

4. The cap of claim 3, further comprising a flexible seal within said cap for engaging the base to the medicine bottle or vial.

5. The cap of claim 1, wherein the top has a first position in which the plurality of dials can not rotate and a second position in which the plurality of dials can rotate.

6. The cap of claim 5, wherein the top is rotatable about the support post when the top is in a third position.

7. A bottle for storing medicine with a closure cap having multiple rotating time and date dials for reminding a user when to take a dose, said bottle comprising:

a body having a tubular side wall, the side wall having an upper edge area circumscribing an opening of the body; and a closure cap configured to engage the upper edge area of the side wall to close the opening, wherein the closure cap comprises, a base having a support post, a top configured to engage said support post, a plurality of dials listing time-date indicia configured to rotate in only one direction around the support post, and a seal configured to engage the base and the upper edge area;

said plurality of dials comprising a top dial, middle dial, and bottom dial, each dial having a turning tab, wherein the turning tab of the top dial is configured to extend up and away from the middle dial, the turning tab of the bottom dial is configured to extend down and away from the middle dial, and the turning tab of the middle dial is configured to extend away from the support post and beyond the turning tabs of the too and bottom dial.

8. The bottle of claim 7, wherein the top has a first position in which the plurality of dials can not rotate and a second position in which the plurality of dials can rotate.

9. The bottle of claim 8, wherein the top is rotatable about the support post when the top is in a third position.

10. The bottle of claim 7, wherein one dial displays dates of the month.

11. The bottle of claim 7, wherein one dial displays days of the week.

12. The bottle of claim 7, wherein one dial displays hours of the day.

13. A time-reminder cap for a container, said cap comprising:

a top having a protruding stalk;

a base having a support vast configured to receive said protruding stalk; and a top dial, middle dial, and bottom dial, each dial having a turning tab, wherein the turning tab of the ton dial is configured to extend up and away from the middle dial, the turning tab of the bottom dial is configured to extend down and away from the middle dial, and the turning tab of the middle dial is configured to extend away from the support post and beyond the turning tabs of the top and bottom dial;

at least one of said dials listing time-date indicia;

wherein each dial is rotatable around the support post when the toy is in a first position and not rotatable when the ton is in a second position.

14. The cap of claim 13, wherein the top is rotatable about the support post when the top is in a third position.

15. A closure cap far a container for storing a product that is time sensitive to its application or consumption, such product including baby formula, fertilizer, agricultural products, pool and spa chemicals, pesticides, pet medicines, vitamins, human and pet topical cremes, and homeopathic medicines; said cap comprising:

a base including a support post;

a top configured to engage the support post;

a plurality of dials listing time-date indicia wherein the dials are rotatable around the support post, said plurality of dials include a turning tab on each dial wherein the turning tabs are configured in a manner to have a unique shape to assist a user to activate one or more dials; and indicator means on said cap for designating a specific date and time;

said cap having integral means for connecting said cap to said container;

wherein said plurality of dials comprises a top dial, middle dial and bottom dial and the turning tab of the top dial is configured to extend up and away from the middle dial, the turning tab of the bottom dial is configured to extend down and away from the middle dial, and the turning tab of the middle dial is configured to extend away from the support post and beyond the turning tabs of the top and bottom dials.

16. A closure cap for a container for storing a product that is time sensitive to its application or consumption, said cap comprising:

a base including a support post;

a top configured to engage the support post;

a plurality of dials listing time-date indicia wherein the dials are rotatable around the support post, said plurality of dials include a turning means on each dial by which a user can activate one or more dials; and indicator means on said cap for designating a specific date and time;

said cap having integral means for connecting said cap to said container;

wherein said plurality of dials comprises a top dial, middle dial and bottom dial and the turning tab of the top dial is configured to extend up and away from the middle dial, the turning tab of the bottom dial is configured to extend down and away from the middle dial, and the turning tab of the middle dial is configured to extend away from the support post and beyond the turning tabs of the top and bottom dials.

17. The cap of claim 16, wherein the top has a first position in which the plurality of dials can not rotate and a second position in which the plurality of dials can rotate.

18. The cap of claim 17, wherein the top is rotatable about the support post when the top is in a third position.

19. The cap of claim 16, wherein one dial displays dates of the month.

20. The cap of claim 16, wherein one dial displays days of the week.

21. The cap of claim 16, wherein one dial displays hours of the day.

* * * * *